United States Patent [19]

Bürgin

[11] Patent Number: 4,735,518

[45] Date of Patent: Apr. 5, 1988

[54] INK RIBBON CASSETTE

[75] Inventor: Markus Bürgin, Mönchaltdorf, Switzerland

[73] Assignee: Franz Büttner AG, Switzerland

[21] Appl. No.: 834,996

[22] Filed: Feb. 28, 1986

[30] Foreign Application Priority Data

Mar. 8, 1985 [CH] Switzerland ..... 1064/85

[51] Int. Cl.[4] ..... B41J 33/38

[52] U.S. Cl. ..... 400/232; 400/208; 400/236.2; 74/508; 242/75.5; 242/196

[58] Field of Search ..... 400/232, 236.2, 208, 400/227.2; 242/75.5, 84.2, 196; 74/335, 625, 508

[56] References Cited

U.S. PATENT DOCUMENTS

| | | | |
|---|---|---|---|
| 4,065,983 | 1/1978 | Mimura | 74/335 X |
| 4,079,634 | 3/1978 | Johnstone | 74/335 X |
| 4,137,796 | 2/1979 | Bostrom | 74/625 |
| 4,231,667 | 11/1980 | Behrendt et al. | 400/232 X |
| 4,307,969 | 12/1981 | Daughters | 400/208 |
| 4,317,636 | 3/1982 | Hume | 400/208 |
| 4,353,658 | 10/1982 | Craft | 400/232 |
| 4,369,884 | 1/1983 | Daughters | 206/389 |
| 4,605,325 | 8/1986 | Hofmann | 400/207 |

FOREIGN PATENT DOCUMENTS

| | | | |
|---|---|---|---|
| 0043719 | 7/1982 | European Pat. Off. | 400/208 |
| 2706553 | 8/1978 | Fed. Rep. of Germany | 400/208 |
| 158285 | 9/1983 | Japan | 400/236.2 |
| 62170 | 4/1984 | Japan | 400/236.2 |
| 21289 | 2/1985 | Japan | 400/232 |

OTHER PUBLICATIONS

IBM Tech. Disc. Bulletin, "Variable Speed Ribbon Drive Mechanism", Hagiwara, vol. 24, No. 11B, Apr. 1982, pp. 6112–6113.

IBM Tech. Disc. Bulletin, "Apparatus for Altering Ribbon Feed Increments", Blanck et al., vol. 26, No. 1, Jun. 1983, pp. 301–303.

*Primary Examiner*—Edgar S. Burr
*Assistant Examiner*—James R. McDaniel
*Attorney, Agent, or Firm*—Blum Kaplan

[57] ABSTRACT

An ink ribbon cassette having a multicarbon ribbon for switching from a rapid to a slow multicarbon mode is provided. The cassette includes a coupling element to be driven by a printing device. The coupling element rotates a manually shiftable gear mechanism which includes two sets of gears, which are axially displaceable with respect to each other. Each set of gears includes gears of different sizes with a driving wheel mounted on one set of gears. The driving wheel engages the ink ribbon take-up reel. The ability to change the speed of the ribbon advance makes it possible to use the same multicarbon ink ribbon cassette either for high print quality or for longer print duration.

19 Claims, 2 Drawing Sheets

INK RIBBON CASSETTE

BACKGROUND OF THE INVENTION

This invention relates in general to ink ribbon cassettes.

Generally, two types of ink ribbon cassettes are known to the art. The one-time carbon ribbons in which each space of the ink ribbon is used only once and multicarbon ribbons in which the ink-delivering layer can be used several times. For example, such a multicarbon ribbon may be used three to six times. In practice, a multicarbon ribbon is transported forward with each print symbol by a fraction of the symbol width, namely, by ⅓ to 1/6. In this case, the ink is removed successively in an overlapping mode.

The advantage of the one-time carbon ribbon is that it permits high print quality, while multicarbon ribbons have long writing duration. On the other hand, one-time carbon ribbons have a short writing life span and multicarbon ribbons often suffer from lower print quality.

An ink ribbon cassette making it possible for one machine to use both a one-time carbon ribbon and a multicarbon ribbon is well known in the art as disclosed in German Patent DE-OS No. 3 106 958. This prior art cassette utilizes a friction gear driven by way of a gear mechanism coupled to the typewriter. In order to make it possible to alter the step-by-step advance for various types of ribbons, exchangeable mating gears are used. The selected elements of the gear mechanism are always used with a particular cassette depending on the type of ribbon used. The speed reduction ratio used for one-time carbon ribbons is accordingly different than that used for multicarbon ribbons.

In a typewriter device disclosed in German Patent DE-GM No. 8 113 006, the transport step for the ribbon can be varied in accordance with the length of a stud placed on the ribbon cassette. Therefore, a one-time carbon ribbon inserted into the typewriter is automatically assigned a larger transport step than a multicarbon ribbon.

These prior art mechanisms have been somewhat satisfactory in allowing the use of different types of ribbons on the same printing device. However, they suffer from the disadvantage that the entire cassette, a cassette part, or a part of the printing apparatus must be changed each time there is a switch from one-time carbon ribbons to multicarbon ribbons.

Accordingly, it is desirable to provide a multicarbon ink ribbon cassette which overcomes the shortcomings of the prior art devices described above and allows easy change from a smaller to a larger multicarbon advance.

SUMMARY OF THE INVENTION

Generally speaking, in accordance with the invention, an ink ribbon cassette having a multicarbon ribbin which can be easily switched from one to a different multicarbon mode is provided. The cassette includes a manually shiftable gear mechanism to change the advance speed of the ribbon. The gear mechanism includes a first set of speed change gears coaxially mounted on an axially movable gear shaft, a second set of speed change gears coaxially mounted in the cassette such that when the first set of gears is shifted one of the second gears is engaged. When the operating knob is raised and the larger lower of the first set of gears engages the lower smaller of the second set of gears, the ribbon is advanced at a faster one-time rate. When the knob is lowered, the upper smaller of the first set of gears engages the upper larger of the second set, so that the ribbon is advanced at the slower overlapping or multicarbon rate. This enables the same cassette including the multicarbon ribbon to be driven at either printing mode without changing any parts or cassette.

Accordingly, it is an object of the invention to provide an improved ink ribbon cassette.

Another object of this invention is to provide an ink ribbon cassette with a multicarbon ribbon whhich can be advanced at different speeds.

Yet a further object of the invention is to provide an ink ribbon cassette for a printing device which allows for shifting between printing modes in response to the same print drive of the printing device.

Yet another object of the invention is to provide an ink ribbon cassette with a multicarbon ribbon which can be advanced to provide high print quality or longer use.

Still other objects and advantages of the invention will in part be obvious and will in part be apparent from the specification and drawings.

The invention accordingly comprises the features of construction, combination of elements, and arrangement of parts which will be exemplified in the construction hereinafter set forth, and the scope of the invention will be indicated in the claims.

BRIEF DESCRIPTION OF THE DRAWINGS

For a fuller understanding of the invention, reference is had to the following description taken in connection with the accompanying drawings, in which.

DESCRIPTION OF THE PREFERRED EMBODIMENTS

Figure 1:
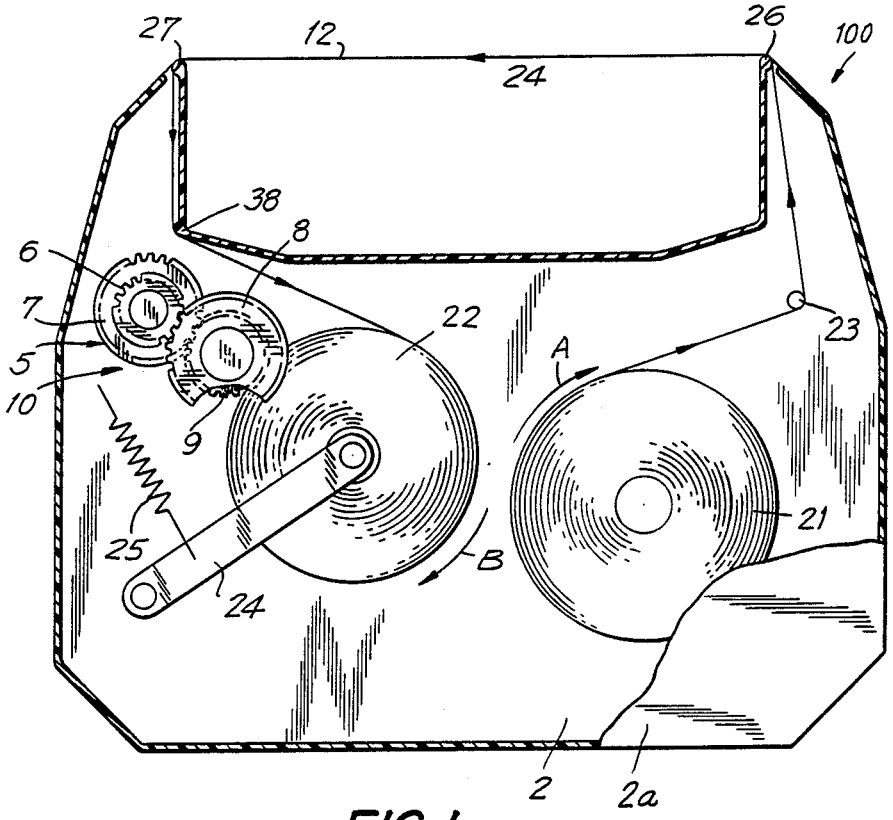
FIG. 1 is a top plan view of an ink ribbon cassette constructed in accordance with the invention with the cover partially removed.

Reference is made to FIG. 1 wherein a plan view of an ink ribbon cassette constructed in accordance with the invention is shown generally as 100. Cassette 100 includes a cassette housing 2 and a cooperating top 2*a*, a portion of which is shown. A feed reel 21 of a multicarbon ink ribbon 12 is rotatably mounted in housing 2. A take-up reel 22 is rotatably mounted in cassette 100 on a swiveling lever 24 which is rotatably mounted on cassette housing 2. A spring 25 is attached to swivel arm 24 to bias take-up reel 22 against a drive wheel 11.

By rotation of drive wheel 11 mounted on a shaft 28, ribbon 12 is taken off feed reel 21 in the direction shown by an arrow A in FIG. 1. Ribbon 12 is transported to take-up reel 22 by way of a guide pin 23 acting as a first guide member, outer edges 36 and 37 and edge 38 all act as further guide members. Drive wheel 11 is driven via cooperating speed-change gears 5,10 by a coupling member 20 of the printing device. Coupling member 20 engages a countersunk recess formed in a pivot 14 which is coupled to a shaft 33 by a pair of cams 17, as will be described in more detail with respect to FIG. 2.

Figure 2:
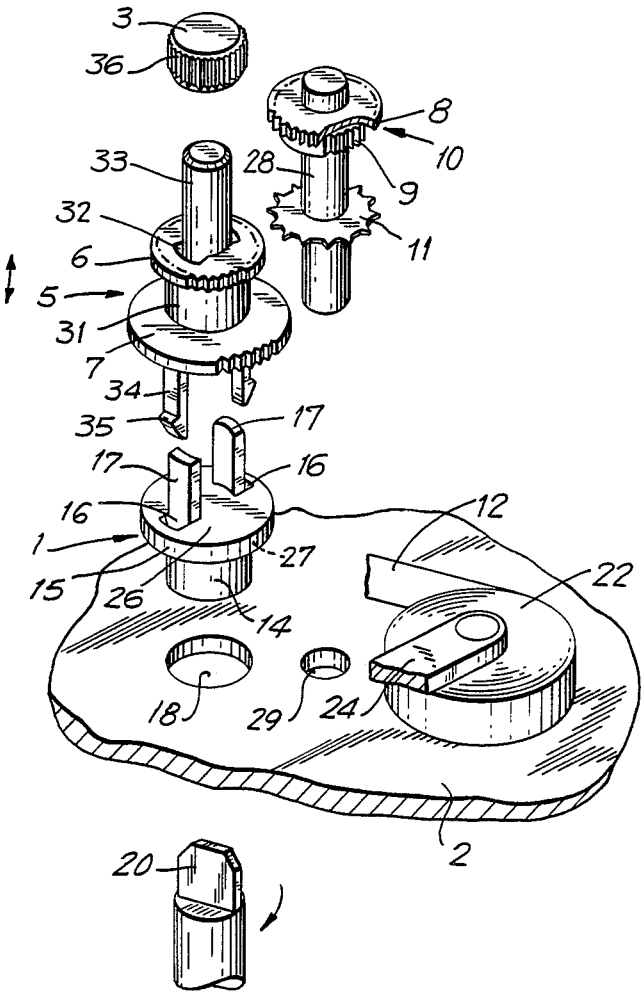
FIG. 2 is an exploded perspective view of the gear assembly of the cassette gear shifting mechanism.

Referring now to FIG. 2, an exploded perspective view of the gear shift mechanism of cassette 100 is shown. A disc 15 is formed on pivot 14 with elongated cams 17 projecting upwardly from disc 15. Pivot 14 rotates freely and extends through a hole 18 in cassette housing 2. Disc 15 is formed with two openings 16 adjacent to cams 17. Cams 17 are tortionally rigid, but move axially with gears 5 which has a smaller upper speed gear 6 and a larger lower speed gear 7. Gears 6 and 7 are rigidly mounted on the shaft 33 which rotates in housing 2.

A collar 31 is rigidly attached between gears 6 and 7 and is formed with two recesses 32 for cooperating with cams 17 and allowing cams 17 to pass through gears 6 and 7. A pair of downwardly projecting cams 35 are formed on the bottom of gear 7 and include spring legs 34. Spring legs 34 are rigid in the axial direction, but are movable in a side-to-side direction and are positioned to be inserted into openings 16 in disc 15. An actuating button 3 is formed with a gnarled outer surface 36 and is rigidly mounted on the top portion of shaft 33. Actuating button 3 extends beyond casing top *2a*.

By pulling or depressing button 3, gears 6 and 7 can be displaced axially in housing 2 in two gear shift positions. The shift positions are locked by the interaction of cams 35 with disc 15. When actuating button 3 is depressed, cams 35 pass through hole 16 in disc 15 and come in contact with a lower shoulder 27 of disc 15. This locks the shifting element in a down position. At the same time, cams 17 project through recesses 32 formed in collar 31.

Second set of speed change gears 10 includes an upper larger gear 8 and a lower smaller gear 9 formed on shaft 28 rotatably mounted in housing 2. When button 3 is lowered and first speed change gears 5 are locked in a downward position, upper smaller gear 6 engages upper larger gear 8. When actuating button 3 is raised, gears 6 and 7 are shifted in the upward position and cams 35 move through openings 16 in disc 15. At this time, cams 35 rest on an upward shoulder 26 of disc 15. Cams 35 are formed with an upper and lower inclined surface to facilitate passing through holes 16. Cams 35 prevent accidental shifting of shifting element 5 in the axial direction.

This shifting of speed change gears 5 in the axial direction results in a change in ribbon advance speed. For example, when actuating button 3 is depressed, small riving gear 6 engages larger driven gear 8 to provide for slow ribbon advance for overlapping striking. In order to change the position which allows for a faster advance of the ribbon, actuating button is raised thereby engaging larger drive gear 7 and smaller driven gear 9. As upper gear 8 is larger than gear 9, gear 7 must be large enough to mesh with gear 10. This prevents the gear shifting mechanism from passing beyond gear 8 which acts as a further lock in the axial direction.

The meshing of gears 8 with gear 6 or gear 9 with gear 7 produces a torque in shaft 28 which, in turn, causes drive wheel 11 to rotate. As described above, rotation of drive wheel 11 causes take-up reel 22 to rotate in the direction shown by an arrow B in FIG. 1. Actuating button 3 has a gnarled surface 36 so that ribbon 12 may be tightened or advanced by hand.

Accordingly, by providing a gear shift mechanism as described an ink ribbon may be wound at one of two speeds. Additionally, by providing this gear shift assembly, easy change of ribbon advance speeds may be provided by merely displacing an actuating button on the exterior of the cassette housing. Thus, the ribbon speed may be changed without even removing the cassette from the printing device. By utilizing a shiftable gear mechanism as described herein, high print quality or longer use can be obtained optionally with the same multicarbon ribbon. This eliminates the need to keep available different types of cassettes and exchange the cassettes when changing the speed. This also reduces production costs and storage costs as printing in both modes can be accomplished with the same cassette. Finally, an ink ribbon cassette constructed in accordance with the invention is particularly well suited for providing the same multicarbon ribbon for higher print quality or longer print use.

It will thus be seen that the objects set forth above, among those made apparent from the preceding description, are efficiently attained and, since certain changes may be made in the above construction without departing from the spirit and scope of the invention, it is intended that all matter contained in the above description or shown in the accompanying drawings shall be interpreted as illustrative and not in a limiting sense.

It is also to be understood that the following claims are intended to cover all of the generic and specific features of the invention herein described and all statements of the scope of the invention which, as a matter of language, might be said to fall therebetween.

What I claimed is:

1. An ink ribbon cassette for a printing device having a drive element, comprising:

a housing;

an ink ribbon supply reel rotatably mounted on the housing;

a take-up reel rotatably mounted in the housing;

a ribbon drive mounted inside the housing and operatively coupled to the printing device drive element and take-up reel for winding the ink ribbon in response to advance of the drive element;

the ribbon drive means including gear means disposed entirely inside the housing having at least two optionally controllable gear shift positions for selectively changing the speed of the ribbon advance in response to a change of the gear shift position;

the gear means including a first set of gears with two gears of different size rotatably mounted in the housing and a second set of gears with two gears of different size operatively coupled to the take-up reel, one of the first and second set of gears being axially moveable relative to each other while maintaining tortional rigidity, whereby one gear of the two sets meshes with the other in each of the two gear shift positions.

2. The ink ribbon cassette of claim 1, wherein the gear means includes a manually controllable actuating element for changing the gear shift position.

3. The ink ribbon cassette of claim 1, wherein the gear means includes arresting devices for locking the gear means in the selected gear shift positions.

4. The ink ribbon cassette of claim 1, wherein the first set of gears is axially moveable in relation to the coupling element and the aresting devices are integral components of the first set of gears and of the coupling element.

5. The ink ribbon cassette of claim 4, wherein the arresting devices comprise at least one spring-loaded cam mounted on the first set of gears and an axially affixed collar having two surfaces mounted on the coupling element, the cam resting against one of the surfaces in each gear shift position.

6. The ink ribbon cassette of claim 1, wherein the moveable set of gears is formed with a manually actuating element projecting beyond the housing.

7. The ink ribbon cassette of claim 6, wherein the actuating element is a coaxial actuating button connected with the moveable set of gears.

8. The ink ribbon cassette of claim 7, wherein the actuating button is rigidly connected with the moveable set of gears and is formed with a gnarled surface to facilitate manual winding of the ink ribbon and change of position of the gears.

9. The ink ribbon cassette of claim 1, wherein the coupling element is formed with two elongated projecting cams and the coaxial first set of gears engaged to the coupling element is formed with a collar mounted between the two gears of different size, the collar formed with at least two recesses for receiving the projecting cams on the coupling element, whereby the coaxial set of gears is driven by the coupling element in response to the printing drive element.

10. The ink ribbon cassette of claim 9, wherein the first set of gears is formed with at least one spring-loaded cam, and the coupling element is formed with at least one opening having two cam resting surfaces, the opening for receiving the cam in two positions when the set of gears is displaced between the two operative gear shift positions.

11. The ink ribbon cassette of claim 10, wherein the spring-loaded cam is an elongated member extending from the lower gear of the first set of gears and includes a flexible neck portion and an enlarged head portion with cam surfaces for engaging the coupling member.

12. The ink ribbon cassette of claim 11, wherein the head portion is formed with inclined surfaces to facilitate displacement between the two gear shift positions.

13. The ink ribbon cassette of claim 12, wherein the first set of gears is formed with two spring-loaded cams and the coupling member is formed with two receiving openings.

14. The ink ribbon cassette of claim 1, wherein the first set of gears includes an upper smaller gear and a lower larger gear, the second set of gears includes an upper larger gear and a lower smaller gear, the first set of gears axially displaceable so that the lower gears of each set engage when the first set of gears is displaced upwardly to advance the ribbon rapidly in a one-time mode and so that the upper gears engage when the first set of gears is displaced downwardly to advance the ribbon slowly in a multicarbon mode.

15. The ink ribbon cassette of claim 14, further including a driving wheel mounted on the second set of gears and operatively coupled to the take-up reel.

16. The ink ribbon cassette of claim 15, wherein the take-up reel is biased towards the second set of gears for maintaining engagement between the take-up reel and the driving wheel.

17. An ink ribbon cassette for a printing device having a drive element, comprising:

a housing;

an ink ribbon supply reel rotatably mounted in the housing;

a take-up reel rotatably mounted in the housing;

a ribbon drive means mounted inside the housing operatively coupled to the printing device drive element and take-up reel for turning the take-up wheel in response to advance of the drive element;

the ribbon drive means including gear means disposed inside the housing having at least two optionally controllable gear shift positions for electively changing the speed of the ribbon advance in response to a change of the gear shift position;

the gear means including a first set of gears with two gears of different size rotatably mounted in the housing and coaxial and connected tortionally rigid with a coupling element engaged with the drive means, and a second set of gears with two gears of different size operatively coupled to the take-up reel, the first and second set of gears being axially movable relative to each other, whereby one gear of each of the two sets meshes with the other in each of the two gear shift positions, the first set of gears includes an upper smaller gear and a lower larger gear, the second set of gears includes an upper larger gear and a lower smaller gear, the first set of gears axially displaceable so that the lower gears of each set engage when the first set of gears is displaced upwardly to advance the ribbon rapidly in a multicarbon mode and so that the upper gears of each set engage when the first set of gears is displaced downwardly to advance the ribbon slowly in a multicarbon mode;

the first set of gears is axially moveable in relation to the coupling element; and the coupling element is formed with two elongated projecting cams and the coaxial first set of gears engaged to the coupling the first set of gears is axially moveable in relation to the coupling element; and the coupling element is formed with two elongated projecting cams and the coaxial first set of gears engaged to the coupling element is formed with a collar mounted between the two gears of different size, the collar formed with at least two recesses for receiving the projecting cams on the coupling element, whereby the coaxial set of gears is driven by the coupling element in response to the printing drive element.

18. The ink ribbon cassette of claim 17, further comprising a spring for biasing the take-up reel again the drive means.

19. The ink ribbon cassette of claim 3, wherein the gear means includes a first set of gears with two gears of different size rotatably mounted in the housing and coaxial and connected tortionally rigid with a coupling element engaged with the drive means, and a second set of gears with two gears of different size operatively coupled to the take-up reel, the first and second set of gears being axially moveable relative to each other, whereby one gear of each of the two sets meshes with the other in each of the two gear shift positions.

* * * * *